United States Patent [19]

Sowden

[11] 4,364,737

[45] Dec. 21, 1982

[54] METHOD FOR CONNECTING TOGETHER A PLURALITY OF WEBS OF FLEXIBLE MATERIAL

[76] Inventor: Terence D. Sowden, 32 Marlborough Rd., Idle, Bradford, BD 10 9SY, West Yorkshire, England

[21] Appl. No.: 225,231

[22] Filed: Jan. 15, 1981

Related U.S. Application Data

[62] Division of Ser. No. 65,653, Aug. 10, 1979, abandoned.

[30] Foreign Application Priority Data

Feb. 28, 1979 [GB] United Kingdom ..... 7907009

[51] Int. Cl.[3] ..... B31F 1/00

[52] U.S. Cl. ..... 493/346; 493/350; 493/353; 493/390

[58] Field of Search ..... 493/390, 353, 352, 346, 493/381, 410, 409, 350

[56] References Cited

U.S. PATENT DOCUMENTS

| | | | |
|---|---|---|---|
| 2,107,462 | 2/1938 | Wood | 493/390 X |
| 2,749,816 | 6/1956 | Jewell | 493/390 |
| 2,812,005 | 11/1957 | Koenig | 493/382 X |
| 2,935,002 | 5/1960 | Robinson, Jr. | 493/390 X |
| 3,233,526 | 2/1966 | Sherman | 493/390 X |

*Primary Examiner*—James F. Coan

*Attorney, Agent, or Firm*—Reising, Ethington, Barnard, Perry & Brooks

[57] ABSTRACT

An apparatus for connecting together a plurality of webs of flexible material. The apparatus comprises a base having an anvil with a sharp edged opening therein the opening comprising a shank region and an enlarged head region. A punching head movable towards and away from the base carries a punch having a sharp edge and also comprising a shank region and elongated head region which are capable of fitting closely within the corresponding regions of the anvil opening. Either or both of the punch and anvil opening are devoid of a sharp edge adjacent that end of the respective shank region which is remote from the respective enlarged head region. When two or more webs are placed between the punch head and the anvil and the punch is moved into the anvil opening the sharp edges of the punch and opening punch a portion of material having a shank and enlarged head from each web and said portion remains joined at the base of said shank to the associated web. The apparatus may be manufactured in a hand-operated version as substitute for a stapling machine or in an industrial version possibly power operated and useful for example in attaching packets to display cards.

6 Claims, 7 Drawing Figures

METHOD FOR CONNECTING TOGETHER A PLURALITY OF WEBS OF FLEXIBLE MATERIAL

This is a division, of application Ser. No. 65,653, filed Aug. 10, 1979, and now abandoned.

This invention relates to apparatus for connecting together a plurality of webs of flexible material.

There are many areas where webs of flexible material need to be connected together, some of these being the securing together of a number of sheets of paper, for example in office use, the securing of packets to display cards, the securing together of parts of folded blanks to form cartons and other containers and the fastening together of two ends of a length of strapping for packaging applications.

There are many well-known methods of securing together webs of flexible material. Perhaps stapling machines are the most common example, but these have drawbacks in that the staples can be difficult to remove from the stapled sheets, the machines require constant reloading and staples are not completely interchangeable from one machine to another. According to the present invention apparatus for connecting together a plurality of webs of flexible material comprises a base; an anvil incorporated in said base and having an opening therein, at least part of the opening being defined by a first sharp edge and said defined part comprising a shank region and an enlarged head region; a punching head; means mounting said punching head for movement towards and away from said base; and a punch incorporated in said punching head, at least part of said punch being delineated by a second sharp edge and said delineated part comprising a shank region and an elongated head region which are respectively capable of fitting closely within said shank region and enlarged head region of said defined part of the opening in said anvil; at least one of said punch and said anvil opening being devoid of a sharp edge adjacent that end of the respective shank region which is remote from the respective enlarged head region, whereby when said webs are placed between said punch head and said anvil and said punch is moved into said anvil opening said first and second sharp edges punch a portion of material having a shank and an enlarged head from each web and said portion remains joined at the base of said shank to the associated web.

To illustrate use of the apparatus if two sheets of paper are placed one on top of another, folded over at one corner to form four thicknesses and those four thicknesses are placed between the anvil opening and the punch and are then punched, it will be found that when the punched sheets are withdrawn from the apparatus they will be attached to one another. If the folded corner is smoothed back after punching the sheets will still remain attached to one another by virtue of the engagement of the enlarged heads of the punched portion engaging in the shank openings. The method is equally applicable to two sheets of flexible material other than paper, and also to more than two sheets of flexible material. If a substantial number of sheets are to be connected then it is found that it will suffice to fold over the corner of, say, the two uppermost and two lowermost sheets and to punch through the folded parts and the remainder of the sheets simultaneously. The same connecting effect as with two sheets is then obtained.

In all these cases the sheets can easily be separated from one another because only the punched portion holds them together. Furthermore, no materials other than the webs themselves are needed to maintain the connection, the use of separate fasteners such as staples being avoided.

The apparatus may further comprise guide means operative, as part of said webs advance into said apparatus, to fold said advancing parts back over the remainder of said webs and to position said folded-back parts and part of the remainder of said webs over said anvil opening.

In one form of the apparatus the mounting means comprises a pivotal connection between said base and said punching head located remote from said anvil opening and punch. In an alternative form the mounting means comprises guiding means for guiding said punching head along a reciprocal path towards and away from said base. In either case bias means may be provided for biasing the punching head away from the base so that the punching action takes place against the biasing force. The apparatus may be constructed in various forms ranging from light-weight hand-held devices designed for office use to power operated multi-anvil devices for industrial use.

The form of the defined part of the anvil opening and the delineated part of the punch is not critical as long as each has a respective shank region and enlarged head region. These combined regions could alternatively be described as a generally T-shaped slot and the punch shape includes all forms from a true T-shape through a key-hole shape to a triangular shape of which the narrower part can be considered a stem and the broader part an enlarged head.

The invention will be better understood from the following description of certain specific embodiments thereof, given, by way of example only, in connection with the accompanying drawings in which.

Figure 1:
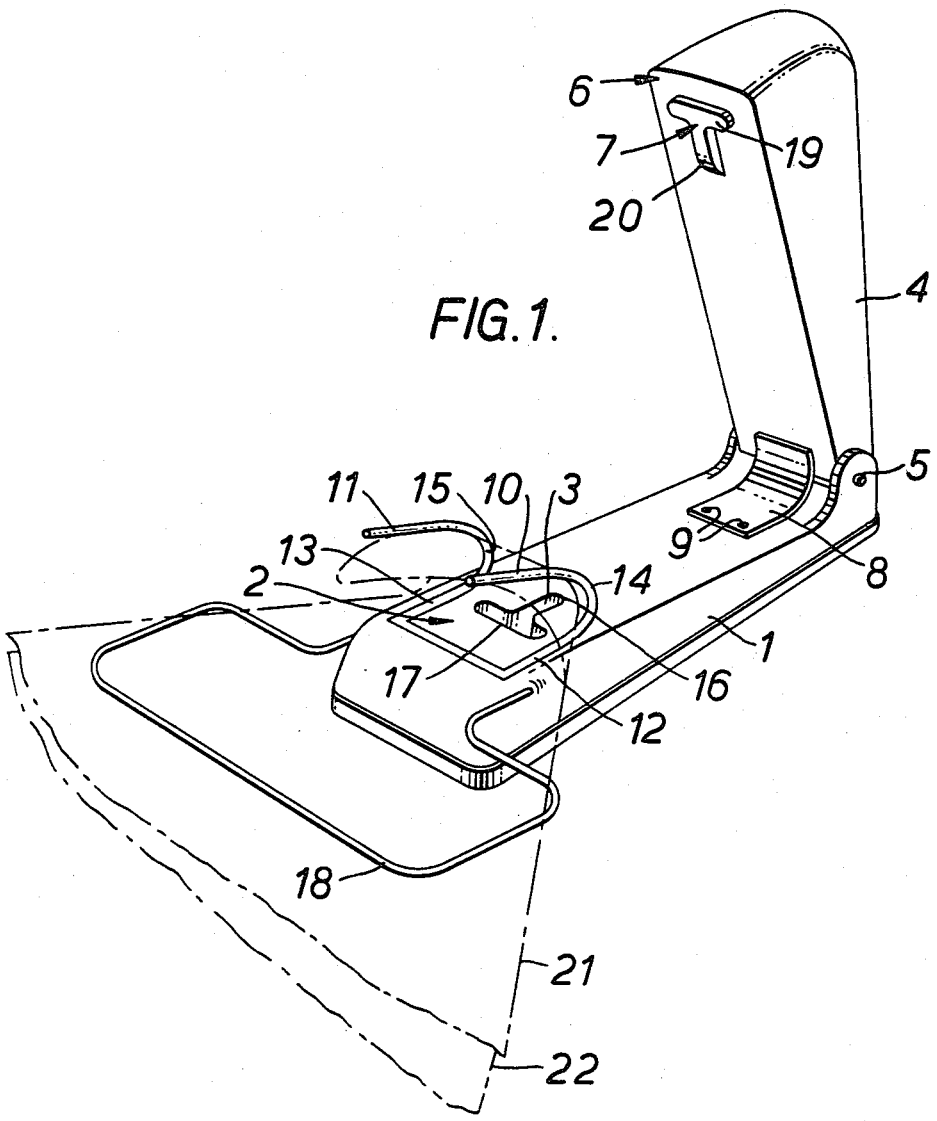
FIG. 1 is a perspective view of a first form of apparatus according to the invention.
Figure 2:
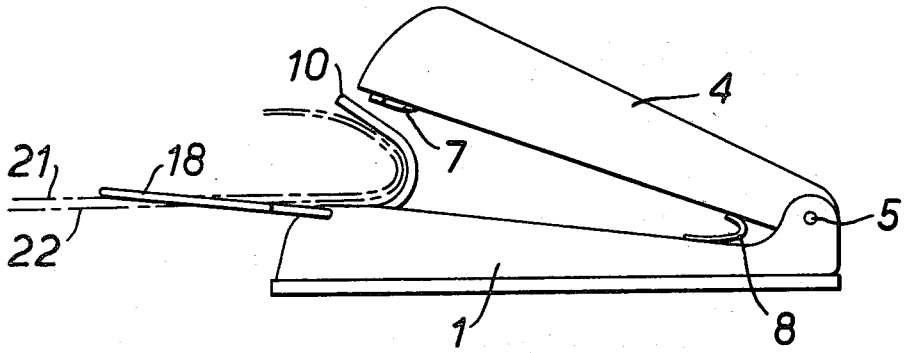
FIG. 2 is a side elevation of the apparatus shown in FIG. 1.

Referring now to FIGS. 1 and 2 these show a form of the apparatus designed for light office use. The apparatus consists of a metal base, which may be rubber-faced on its underside to give a non-slip standing surface. The top side of the base incorporates a hard steel anvil section 2 having a T-shaped slot 3 formed therein. The slot may be of limited depth or may extend completely through the base. The anvil section may be an integral part of the base or may be a separate insert into the material of the base and secured thereto by adhesive, screws or any other suitable means.

An elongate arm 4 is pivotally mounted at one end to the base about pivot pins such as 5. The arm has a punching head section 6 which may be integral with the arm or a separate part secured to the arm. The punching head section has incorporated therein a punch 7 which is again substantially T-shaped. A leaf spring 8 is secured to the base 1 by rivets 9 and is bent so that its free end engages the underside of the elongate arm 4 in order to bias that arm away from the base.

Two substantially U-shaped resilient wire guides 10 and 11 project upwardly from the base and are located one to each side of the anvil opening 3. Each guide has a lower part 12, 13 respectively which is located in a groove in the upper surface of the base 1 and held within the groove by, for example, a suitable adhesive. The bight 14, 15 respectively of each wire guide is located beyond the end 16 of the anvil opening 3. The free ends of the upper parts of the wire guides lie ahead of the opposite end 17 of the anvil opening. A further rectangular wire guide 18 projects forwardly from the base and in front of the guides 10 and 11, the ends of the guide 18 again being received in recesses within the base 1 and being secured thereto by a suitable adhesive or other means.

The form of the anvil opening 3 and the punch 7 is clearly seen from FIG. 1. The whole of the opening is defined by a first sharp edge and comprises a shank region terminating at the end 16 and an enlarged head region terminating at the end 17, the whole being of substantially T-shape. The anvil opening and the punch are of substantially the same shape and the punch projects a given distance from the punching head and terminates in a web-contacting surface 19. A first part of the web-contacting surface is delineated by a second sharp edge and comprises the enlarged head region and that part of the shank region which is closest to the enlarged head region. A second part 20 of the web-contacting surface forms an extension from the shank region and tapers away from the first part of that surface towards the punching head. The tapered part of the surface blends smoothly into the remainder of the shank and the junction between the two is not sharp. The whole of the punch 7 is capable of fitting closely within the anvil opening 3.

To use the apparatus to connect together two sheets of paper the sheets 21, 22 are placed one on top of the other and one corner of the combined sheets is then fed into the opening in the guide 18 from below the guide and into and around the guides 10 and 11 so that the corner will automatically be folded back on itself to the position shown in the drawings. Eventually the shape of the guide 18 will prevent the sheets of paper from being fed any further forward into the apparatus. The punching head can then be brought down onto the anvil against the action of the leaf spring 8. Four thicknesses of paper will be punched from the two folded over sheets and the punched T-shaped portions will be pushed through the sheets but will not be separated from them. Thus, the shank of each punched portion remains joined to the associated sheet due to the presence of the tapered section 20 of the punch and the fact that this does not include a sharp cutting edge transversely of the shank.

When the sheets are subsequently withdrawn from the apparatus, they will be found to be secured together at the folded corner. If the fold is opened out, the two sheets will stay secured to one another, with the enlarged head portions engaging behind the cut-out shank portions of the sheets.

Figure 3:
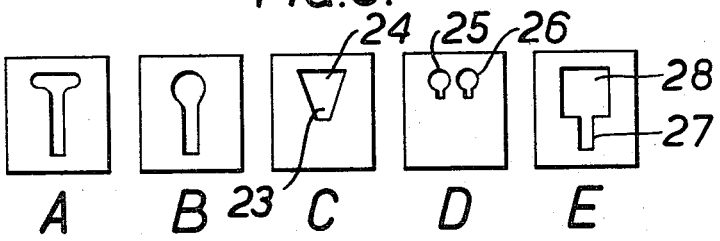
FIG. 3 shows, in views A through E plan views of five different anvils that may be used in the practice of the invention.

FIG. 3 shows a series of anvils having different shaped openings, each of which may be used with a correspondingly shaped punch in apparatus of the invention. The anvil A has a T-shaped opening which corresponds substantially to the opening shown in the apparatus of FIGS. 1 and 2. Anvil B has an opening which tends more towards a key-hole shape and also has a shank region and an enlarged head region. Anvil C has a triangular opening, which can be considered as having a stem comprising the narrower part 23 of the triangle and an enlarged head comprising the broader part 24 of the triangle. Anvil D has two openings 25 and 26 arranged side by side each of miniature key-hole form. Anvil E has a larger opening comprising a shank 27 and an enlarged square head 28. This latter anvil may be particularly useful in apparatus for securing together the two ends of a length of strapping extending around a load. If the ends are brought together and are punched on the anvil E with a punch head of the same shape, the shank of the punch tapering into the punch head as already described, then squares of the strapping material each secured to the material by a shank will be punched from the material. If tension in the strapping is then released the ends of the strapping will move relatively and the square heads will engage behind the slots so holding the strapping in a secure condition.

Figure 4:
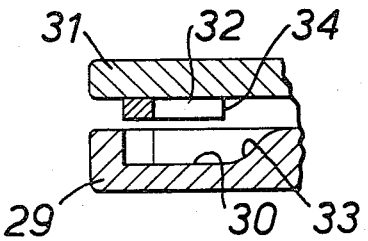
FIGS. 4 and 5 show respectively partial longitudinal cross-sections through alternative punch and anvil forms.
Figure 5:
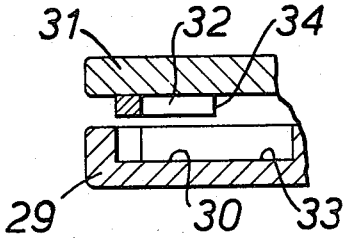

The apparatus shown in FIGS. 1 and 2 ensures that the punched portions of material remain attached to the main body of the material by tapering the punch head as at 20 so that the shank of material is not cut through. This result may be achieved alternatively by adopting either of the constructions shown in FIGS. 4 and 5. Each of these Figures shows a base 29 including an anvil opening 30 of substantially T-shape. A punching head 31 is positioned above the base and carries a substantially T-shaped punch 32. The whole of the punch is delineated by a sharp edge. In each case the anvil opening includes an extension 33 of the shank region beyond the end 34 of the shank region of the punch so that as that end enters the anvil opening there is no cutting effect on material laid between the punch and the anvil. The arrangement shown in FIGS. 4 and 5 differ only in that in the FIG. 4 arrangement the extension 33 of the shank section tapers upwardly to meet the upper surface of the base, while in the FIG. 5 embodiment no such taper is included.

Figure 6:
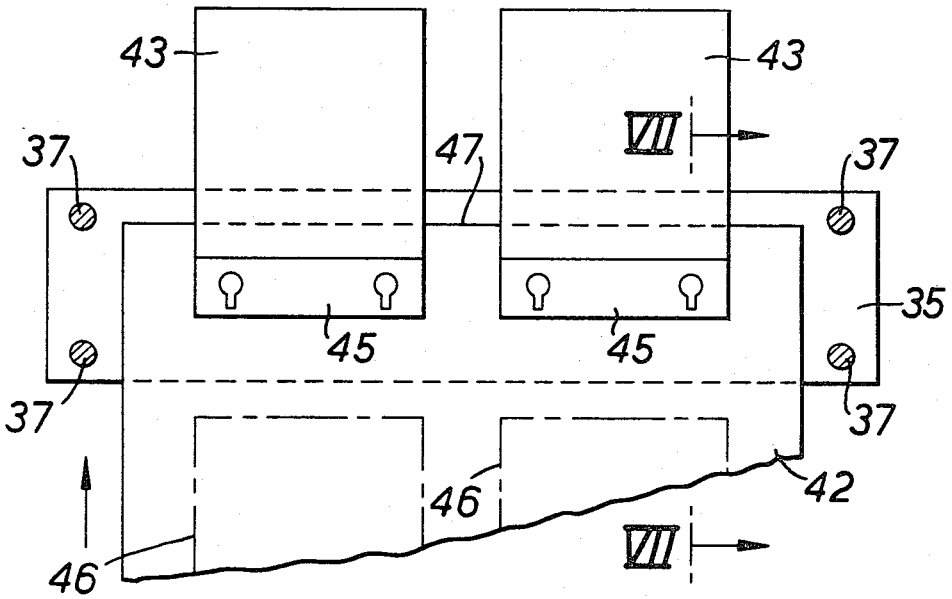
FIG. 6 illustrates in partial schematic plan view use of an alternative form of apparatus according to the invention in attaching packets to display cards.
Figure 7:
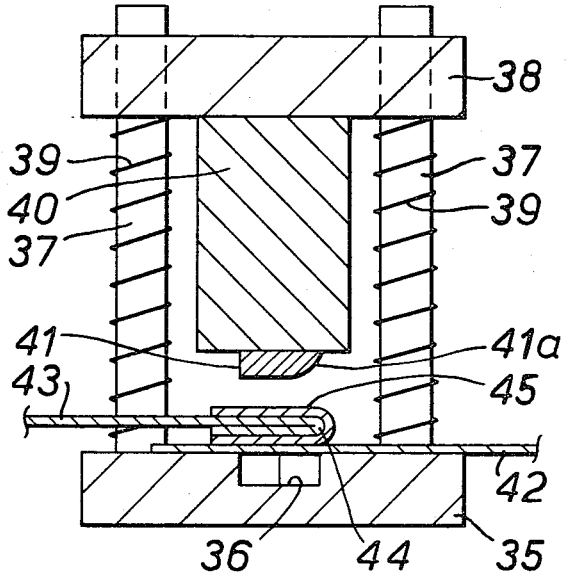
FIG. 7 is a cross-section on the line VII—VII of FIG. 6.

FIGS. 6 and 7 show schematically a form of apparatus that may be used for securing packets to a display card. The apparatus comprises a base 35 in which are incorporated a plurality of anvils each having an anvil opening 36 of generally key-hole form. Four guide pillars 37 extend upwardly from the base and guide thereon a punch carrier 38 supported above the base. Compression springs 39 may surround each of the pillars 37 to bias the carriers away from the base. The carrier 38 carries a punching head 40 which on its lower surface has a plurality of key-hole shaped punches 41, each arranged to engage within a respective one of the anvil openings 36. Each punch 41 has an enlarged head and a shank, both delineated by a sharp edge, and a shank extension 41*a* which tapers smoothly to meet the punching head, so that as the punch engages the anvil opening a key-hole-shaped piece of material is punched out but is left attached to the remainder of the material as already described. A display card 42 with its front side uppermost is fed into the apparatus and packets such as 43 are provided to be secured to the card. The drawing shows two packets to be attached to the card side by side in a series of rows but it will of course be appreciated that by proper choice of anvil and punches a greater number of packets can be attached. Each packet is laid on the card with its front side downwards and with its upper edge folded over as at 44 to give a double thickness, a strip of card 45 being folded around the folded edge of the packet as best seen from FIG. 7. With the packets and card strip arranged as shown in this Figure the punch carrier is lowered towards the base either manually or under power and the punches punch through the two thicknesses of strip 45, two thicknesses of packet 44 and single thickness of display card 42. The card may then be advanced in the direction of the arrow shown in FIG. 6 and a further two packets placed on the card in the positions outlined by the broken lines 46, whereupon the punching operation may be completed. When the required number of packets have been punched to the card in this way the card is taken from the apparatus and can be used for display with the edge 47 of the card uppermost, the packets falling and unfolding to lie adjacent the card with the strip 45 uppermost. The packets may then be pulled individually from the card as required.

It will be understood that, rather than attach packets to the card one row at a time as described with reference to FIGS. 6 and 7 a larger form of the apparatus may be constructed designed to punch a plurality of packets in each of a plurality of rows to the card simultaneously.

I claim:

1. A method for connecting together a plurality of webs of flexible material comprising: folding said plurality of webs, punching a hole through said folded plurality of webs so as to pass therethrough twice and define punched web portions and remaining openings each of which includes an enlarged head and a narrow shank that extends from the enlarged head and has a base at which the punched portion remains connected to the associated web, and then unfolding the punched webs such that the enlarged heads of certain of the punched portions are received within the narrow shanks of the openings left by other punched portions to thereby lock the webs together.

2. A method as in claim 1 wherein the plurality of webs are folded, punched, and unfolded at a corner thereof.

3. A method as in claim 2 wherein each of said plurality of webs is folded.

4. A method as in claim 2 wherein uppermost and lowermost webs are folded while leaving at least one unfolded web therebetween and then punching through said folded and unfolded webs as well as unfolding the folded webs after the punching.

5. A method as in claims 1, 2 or 3 wherein the punched web portions and remaining openings have a T-shape.

6. A method as in claims 1, 2 or 3 wherein the punched web portions and remaining openings have a key-hole shape.

* * * * *